United States Patent [19]

Rodriguez

[11] 3,996,987

[45] Dec. 14, 1976

[54] CONVERTIBLE VALENCE

[75] Inventor: Edith Rodriguez, St. Thomas, V.I.

[73] Assignee: Lawrence Peska Associates, Inc., New York, N.Y. ; a part interest

[22] Filed: Nov. 19, 1975

[21] Appl. No.: 633,652

[52] U.S. Cl. ..... 160/19; 160/38; 160/330

[51] Int. Cl.[2] ..... E06B 9/00

[58] Field of Search ..... 160/330, 385, 19, 23 C, 160/38

[56] References Cited

UNITED STATES PATENTS

| | | | |
|---|---|---|---|
| 653,484 | 7/1900 | McCullough | 160/19 |
| 1,658,815 | 2/1928 | Oskamp | 160/38 |
| 2,862,549 | 12/1958 | Robbins | 160/38 |
| 3,777,800 | 12/1973 | Susoev | 160/330 X |

*Primary Examiner*—Philip C. Kannan

[57] ABSTRACT

A convertible valence is disclosed in which a valence extending from a flat wall surface has a Velcro (trademark) strip fixed along the inner wall thereof for securing a valence cover thereto so that covers may be removed and replaced by other covers and thereby provide a way for readily changing decorating motifs for different occasions.

1 Claim, 4 Drawing Figures

CONVERTIBLE VALENCE

SUMMARY OF THE INVENTION

A valence is provided for window decoration comprising three flat, rigid, oblong members joined to one another or extending as a continuous piece at right angles to one another, the top and the bottom of the valence each being in a common plane so that the bottom or the top of any one member does not substantially project beyond a common horizontal top line or beyond a bottom horizontal bottom line. The ends of the valence are adapted to fit flushly against a vertical wall surface and are secured to such a vertical wall surface by means of a flat plate secured at a right angle to each end of the valence. The plates point inwardly toward the center of the second member, the second member being of sufficient length to span the width of a window. The first and third members are of sufficient length to extend beyond a window sill. A Velcro (trademark) strip is placed on the inside of the valence for securing a cover such as a valence cover or a drapery that is easily changed to facilitate converting the decor of the valence for different occasions such as for interchanging daytime and night time decorating motifs. The valence cover or drapery has a second Velcro device attached to it for securing it to the Velcro device on the valence.

DETAILED DESCRIPTION OF THE SEVERAL VIEWS OF THE DRAWING

DETAILED DESCRIPTION

There has been a long felt need in the prior art for providing a valence for a window, especially a decorative valence, in which the decor incorporated thereon could be readily and easily changed to suit different occasions such as for interchanging day-time and night time decorating motifs.

It is therefor an object of the present invention to provide a novel valence that fulfills these and other needs of the prior art.

It is also an object of the present invention to provide a novel valence which can have a valence cover or drapery attached thereto and detached there from readily to change the decorating motif by exposing the valence or by attaching a different valence cover or drapery to the valence.

These and other objects have been achieved by the present invention which will become apparent by reference to the disclosure and claims that follow and the appended drawing.

Figure 1:
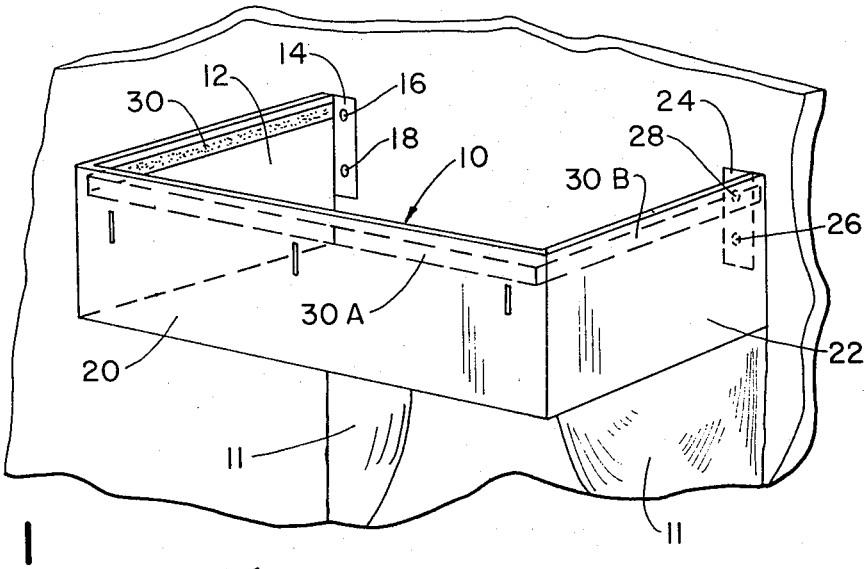
FIG. 1 is a perspective view of a valence according to one embodiment of the present invention.
Figure 2:
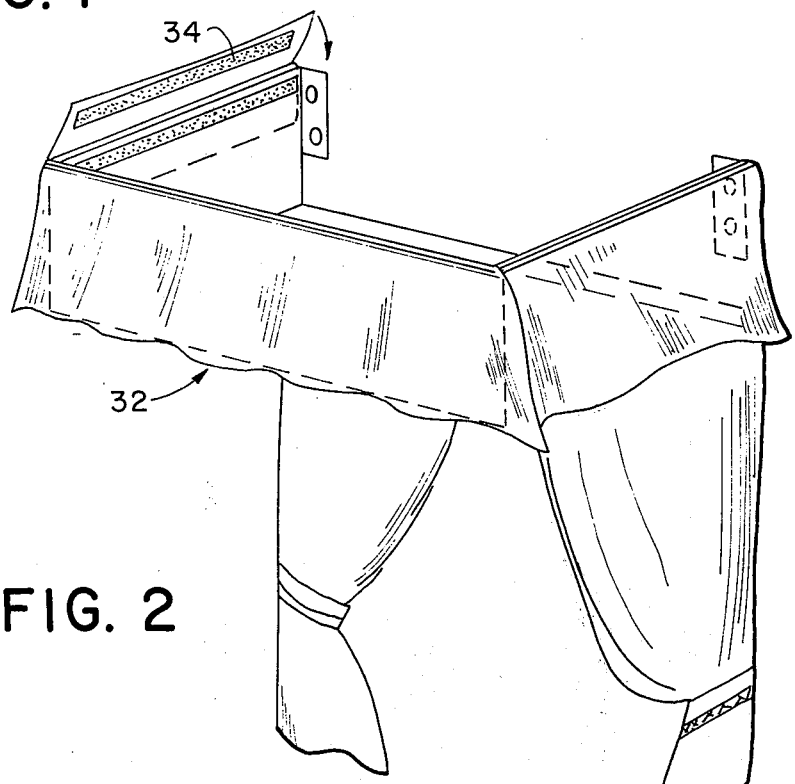
FIG. 2 is a perspective view of a valence and a valence cover partially secured thereto according to another embodiment of the present invention.
Figure 3:
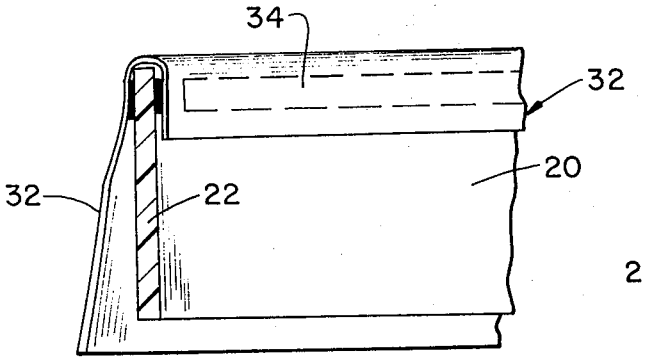
FIG. 3 is a rear elevation of one corner of the valence and valence cover secured thereto according to one embodiment of the present invention.
Figure 4:
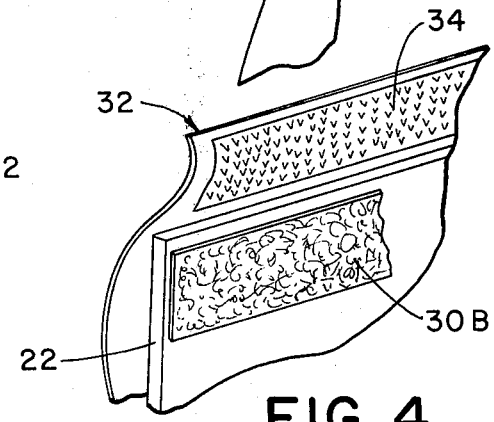
FIG. 4 is a rear perspective of one end of the valence having a valence cover positioned over it ready for securing to the valence according to one embodiment of the present invention.

A valence is illustrated in FIGS. 1 and 2 and sections thereof in FIGS. 3 and 4 in accord with one embodiment of the present invention in which valence 10 is shown consisting of a first rigid flat oblong member 12, one end of which is illustrated as mounted substantially flat against a vertical wall surface, and having a wall mounting bracket 14 secured thereto at the end, bracket 14 comprising a flat plate secured at a substantially right angle to member 12, bracket 14 being adapted to flushly engage a vertical wall surface and being pointed in the direction of the center of member 20. Holes 16 and 18 are provided in bracket 14 for affixing a wall securing device to the bracket so that the end of the valence can be secured to a wall. The wall affixing devices can be either a nail, screw, hook or similar device well known in the art. A second rigid flat rectangular member 20 is provided one end of which extends at a substantially right angle from said first member 12 and is either secured to or integral with member 12. Member 20, or the front panel of valence 10, is of a sufficient length so that it will span the width of a window. The other end of member 20 extends at substantially a right angle to a third rigid flat oblong member 22, member 20 either being integral with member 22 or joined thereto so that the top edge of the aforsaid first, second and third members lie in substantially the same horizontal plane and the bottom edge of the first, second and third members lie in substantially the same horizontal plane. A wall bracket is secured to the end of the third member 22 comprising a second flat plate 24 secured at a substantially right angle to member 22 for flushly engaging a vertical wall surface, plate 24 pointing in the direction of the center of the front panel 20 and having therein holes 24 and 26 for affixing a wall securing device thereto in the manner and using the members previously described. A fastening device 30, 30A and 30B comprising a first Velcro member is secured to the inside of and extends horizontally along the inside walls of the valence 10 comprising members 12, 20 and 22 and is employed for fastening a cover 32 to the outside of the valence, the cover 32 being either a valence cover or a drapery. The valence cover or drapery suitable for covering the valence 10 may be made of any material known in the art such as a woven or non woven fabric, a needle punch fabric or a felt and can be constructed of natural or synthetic fibers including glass fibers known in the art. The cover may be a film of plastic material such as poly vinylchloride, polyethylene or polypropylene all of which are known in the art. Cover 32 which comprises a removable cover extends horizontally around the exterior of valence 10 and is of a length at least sufficient to cover the front of valence 10 or longer as in the case when cover 10 extends downward in a drapery like fashion. The top edge of cover 32 extends up and over the top of valence 10 and then downwardly over the first Velcro strip 30, 30A and 30B, a second Velcro strip 34 secured to the face of cover 32 for joining to the first Velcro strip and being of substantially the same length as the first Velcro strip.

In one embodiment members 12 and 22 are of a sufficient length so that they project beyond a window sill over which valence 10 is mounted so that if cover 32 is of a sufficient length to extend downwardly as a drapery, the cover will not be distorted in its hanging by the sill. Further, in one embodiment, members 12 and 22 are both the same length.

Thus the present invention provides an improved valence which may be optionally provided with means for adjusting the width of front panel 20 or the side panels 12 and 22 such as for example telescoping panels. The valence may be used on different widths of windows and is readily adapted to such when the aforementioned telescoping members are employed. The panels 12, 20 and 22 are covered with the same material as curtains 11 except the panels are heavily lined in one embodiment of the invention. The valence of the present invention is not only easy to install but also inexpensive to manufacture which is unusual because of the highly decorative and versatile effect that is obtained at very low cost. The valence may be decorated with jewels such as stones or alternatively pearls in order to provide an exclusive and expensive apperance. The cover is also decorated with flowers and has golf and silver colored threads running therethrough to provide the same expensive and exclusive appearance. The cover should also be light weight so that it can be supported by the valence.

In use, valence 10 may already have a decorative surface incorporated into the outwardly showing faces of the first, second and third members 12, 20 and 22, or these faces may be plain. In any event when the decorating motif is to be changed in the room in which the valence 10 is used, this can be accomplished quickly and decoratively by removing and replacing cover 32 with a new cover 32 or by installing a cover on valence 32 when it is employed in the room in a manner to exhibit the outer faces of members 12, 20 and 22. The cover 32 is attached or removed from the valence 10 by pressing the first and second Velcro strips on members 12, 20 and 22 into contact with the second Velcro strip on cover 32 or by pulling the first and second Velcro strips apart.

Although the invention has been described by reference to some embodiments it is not intended that it be limited thereby, but that certain modifications are intended to be included within the broad spirit and scope of the foregoing disclosure, the following claims and the appended drawings.

What is claimed is:

1. A valence for window decoration comprising a first rigid flat rectangular member, one end of which is adapted to be mounted substantially flush against a vertical wall surface, wall mounting bracket means secured to said end of said first member, said wall mounting bracket comprising a first flat plate secured at a substantially right angle to said first flat rectangular member for flushly engaging a vertical wall surface, means in said first plate for affixing a wall securing device thereto, a second rigid flat rectangular member one end of which extends at a substantially right angle from said first member and is of a sufficient length to span the width of a window, the other end of said second member extending to a substantially right angle to a third rigid flat rectangular member so that the top edge of said first, second and third members lie in substantially the same plane and the bottom edge of said first, second and third members lie substantially in the same plane, wall mounting bracket means secured to the end of said third member, said wall mounting bracket comprising a second flat plate secured at a substantially right angle to said third member for flushly engaging a vertical wall surface, means in said second plate for affixing a wall securing device thereto, fastening means secured to the inside of and extending horizontally along the inside walls of said first, second and third members for fastening a fabric cover to the outside of said valence said first and second members being of sufficient length to project beyond a window sill and are both the same length, said first, second and third members all being of a horizontal oblong configuration, said bracket on said first member and said bracket on said third member extending inwardly toward the center of said second member, said fastening means comprising a first Velcro strip, a removable cover extending horizontally around the exterior of said valence, said cover being of sufficient length to cover said valence, the top edge of said cover extending up and over the top of said valence and downwardly toward and over said first Velcro strip, a second Velcro strip secured to the face of said cover for joining to said first Velcro strip, said second Velcro strip being of substantially the same length as said first Velcro strip.

* * * * *